United States Patent [19]

Morita

[11] 3,945,776

[45] Mar. 23, 1976

[54] STRUCTURE FOR PREVENTING OIL LEAKAGE IN A ROTARY ENGINE

[75] Inventor: Minoru Morita, Nago, Japan

[73] Assignee: Toyota Jidosha Kogyo Kabushiki Kaisha, Japan

[22] Filed: Apr. 17, 1974

[21] Appl. No.: 461,657

[30] Foreign Application Priority Data

Dec. 29, 1973 Japan ..... 48-49580

[52] U.S. Cl. ..... 418/142; 418/178; 277/96

[51] Int. Cl.[2] F01C 19/08; F04C 27/00; F01C 21/00

[58] Field of Search ..... 418/142, 178; 277/96 A, 277/25; 123/8.01

[56] References Cited

UNITED STATES PATENTS

| | | | |
|---|---|---|---|
| 3,456,624 | 7/1969 | Okamoto | 418/142 |
| 3,693,608 | 9/1972 | Neishi | 418/178 |
| 3,697,202 | 10/1972 | Reinhart | 418/142 |
| 3,718,412 | 2/1973 | McCormick | 418/142 |
| 3,767,212 | 10/1973 | Ludwig | 277/27 |
| 3,804,424 | 4/1974 | Gardner | 277/27 |

FOREIGN PATENTS OR APPLICATIONS

| | | | |
|---|---|---|---|
| 1,334,159 | 6/1963 | France | 418/142 |
| 1,189,786 | 3/1965 | Germany | 123/8.01 |

*Primary Examiner*—John J. Vrablik

*Attorney, Agent, or Firm*—Stewart and Kolasch, Ltd.

[57] ABSTRACT

A structure for preventing oil leakage which occurs between a side wall of a rotor and the inner surface of a side housing in a rotary engine, comprising at least one oil groove formed in the side wall of the rotor in a region located inside of a conventional annular oil seal means. The oil groove formed in the side wall of the rotor extends helically around the center of the rotor.

7 Claims, 7 Drawing Figures

STRUCTURE FOR PREVENTING OIL LEAKAGE IN A ROTARY ENGINE

BACKGROUND OF THE INVENTION

1. Field of the Invention

The present invention relates generally to a rotary engine, and more particularly, to a structure for preventing oil leakage in a rotary engine of the type comprising a rotor adapted to rotate eccentrically within a casing made of at least two side housings and a center housing positioned therebetween wherein the gas and oil tightness between the side wall of the rotor and the side housing is maintained by an oil seal ring mounted in an annular oil seal groove formed in the side wall of the rotor.

2. Description of the Prior Art

In the art of rotary engines of the aforementioned type, various improvements regarding its oil seal structure have been proposed in order to improve the gas and oil tightness at the oil seal portion composed of the annular oil seal groove and the oil seal ring. However, despite such improvements regarding the oil seal means, a considerable amount of lubricating oil leaks out through the oil seal means radially outwardly of the rotor causing the drawback that the rotary engine consumes a considerably larger amount of lubricating oil as compared with the conventional internal combustion engine of the reciprocating type.

SUMMARY OF THE INVENTION

Therefore, it is the object of the present invention to counteract the aforementioned problem and to provide a structure for preventing oil leakage in a rotary engine which is distinguishable from the various conventionally proposed improvements which are principally related with the improvement of the oil seal ring structure. According to the present invention, oil leakage between the rotor side wall and the side housing is more effectively prevented.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, the abovementioned object is accomplished by providing at least one oil seal groove in the side wall of the rotor said oil groove being located radially inside of the annular oil seal groove and extending helically around the center of the rotor. By utilizing the aforementioned helical oil groove, and particularly by arranging the helical groove so as to open radially outwardly along the rotating direction of the rotor, the helical groove applies a radially inwardly directed scratching action of the oil as the rotor rotates, whereby oil is constantly recovered and directed toward the central region of the rotor while at the same time maintaining a good oil film on the rotor side wall and the inside surface of the side housing. Thus, by utilizing the oil groove, according to the present invention the pressing of a large amount of oil into the oil seal means provided at the outside of the oil groove is avoided, and accordingly, oil leakage in the oil seal means is also reduced. The oil and gas tightening performance of the oil seal means is satisfactorily maintained if an amount of oil is supplied which is sufficient to maintain an effective oil film between the oil seal ring and the wall surface of the annular oil seal groove as well as between the oil seal ring and the inner surface of the side housing. A supply of oil beyond the necessary amount does not contribute to an improvement in the oil and gas tightening performance but, in fact, increases oil leakage. Since the amount of oil supplied to the oil seal means is maintained at a proper level by the helical oil groove according to the present invention, the oil and gas tightening performance of the oil seal means is maintained at its optimum level while effectively suppressing oil leakage.

The aforementioned helical oil groove may preferably be provided in plurality and arranged symmetrically around the center of the rotor. In this case, it is advantageous if the plurality of helical grooves are arranged as a multi-layered helical groove wherein some portions of the individual grooves overlap with each other. Thus, a multi-staged helical groove means is obtained as seen along a radial section of the rotor side wall, which renders uniform the oil scraping action over a wider area so as to accomplish a more desirable oil scraping effect as well as affording a good oil and gas tightening effect.

The helical oil groove according to the present invention may preferably be formed so as to have a gradually increasing cross sectional area from its radial outer end portion towards its radial inner end portion. Such an arrangement of the cross sectional area, facilitates the return of the oil scraped by the helical groove and collected in the groove to the central portion of the rotor. The radially outer end of the helical oil groove may join and communicate with the annular oil seal groove of the oil seal means. In this structure, the superfluous oil scraped by the oil seal ring is directly returned to the central portion of the rotor by the helical oil groove provided according to the present invention.

The surface of the side wall portion where the helical oil groove, according to the present invention, is provided may preferably be provided with an anti-wearing surface treatment so that localized heavy wearing in the rotor body can be avoided.

BRIEF DESCRIPTION OF THE DRAWING

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

The present invention will now be described in more detail with respect to some preferred embodiments and with particular reference to the accompanying drawings.

Figure 1:
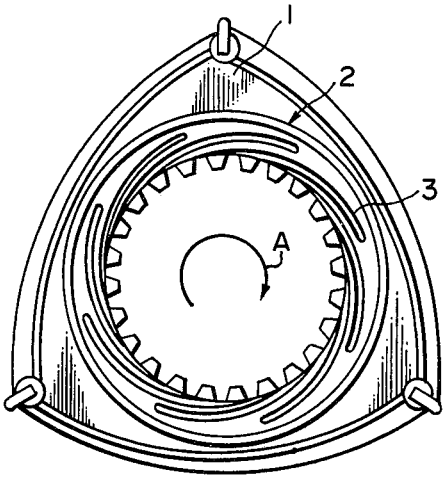
FIG. 1 is a side view of a rotor of a rotary engine incorporating a structure for preventing oil leakage according to the present invention.
Figure 2:
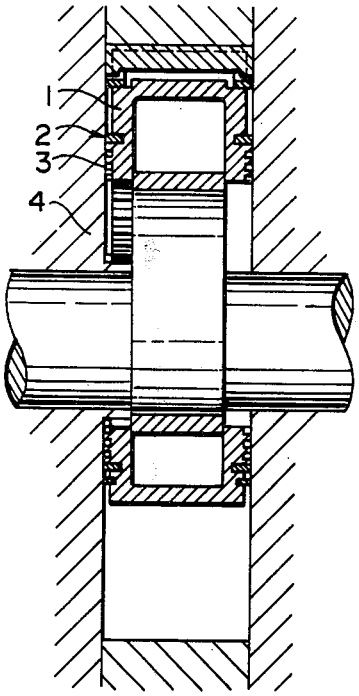
FIG. 2 is a longitudinal section of the rotary engine including the rotor shown in FIG. 1.

FIG. 1 shows a side wall of a rotor of a rotary engine incorporating the structure for preventing oil leakage according to the present invention. The rotor 1 is provided with a plurality of oil grooves 3 which extend helically around the center of the rotor in a region located radially inside of an oil seal means 2 having a conventional structure. As shown in FIG. 2, the oil grooves 3 are provided to oppose to the inner surface of a side housing 4. The shown rotor 1 is designed to rotate in the direction of the arrow A in FIG. 1, and corresponding thereto, the helical grooves 3 are formed to open radially outwardly of the rotor along the direction of the arrow A.

Figure 3:
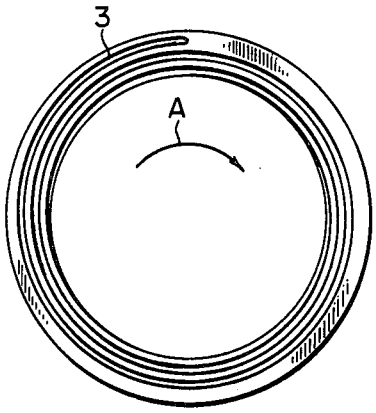
FIG. 3 is a view showing an embodiment of this invention wherein the helical oil groove is formed as a single helical groove.

FIG. 3 shows an embodiment where the helical groove 3 is formed as a single groove.

Figure 4:
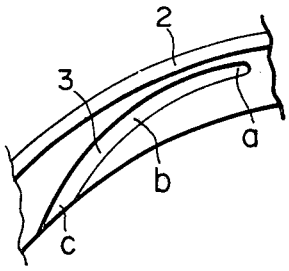
FIG. 4 is a view showing an embodiment of the helical groove in more detail.

FIG. 4 shows the shape of an embodiment of a helical groove 3. In this case, the helical groove 3 is formed so as to widen gradually from its radially outer end portion *a* toward its radially inner end portion c by way of an intermediate portion *b*.

Figure 5:
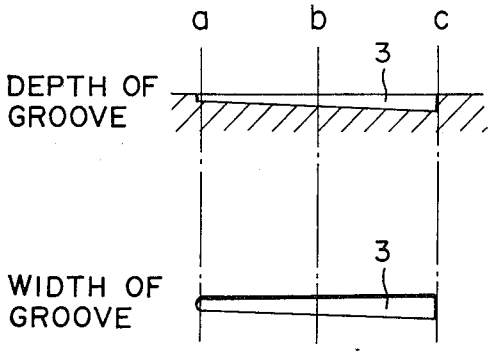
FIG. 5 is a view showing the helical groove shown in FIG. 4 in a straightened condition together with its configuration regarding depth.

In FIG. 5, the helical groove as shown in FIG. 4 is shown in a straightened condition so that the change of its depth is conveniently shown along the groove. As shown in FIG. 5, the groove 3 may be formed to have gradually increasing depth from portions *a* to *c* so that the cross sectional area of the groove is increased gradually from its radial outer end portion to its radial inner end portion but at a rate sufficient to allow free flow of the oil scraped by the entire region of the helical groove toward the radially inner end portion of the groove, wherein the amount of said flow increases gradually as it approaches the radially inner end portion of the groove.

Figure 6:
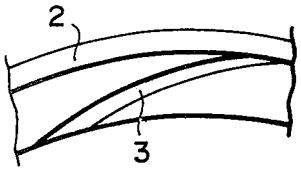
FIG. 6 is a view showing another embodiment of the helical oil groove according to the present invention.

FIG. 6 shows an embodiment where the helical groove 3 joins and communicates with the oil seal groove of the annular oil seal means 2 at its radially outer end portion. In this structure, the superfluous oil scraped by the annular oil seal means is returned directly to the central portion of the rotor by way of the helical groove 3.

Figure 7:
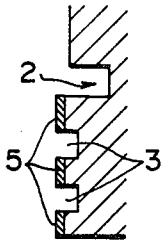
FIG. 7 is a sectional view showing the surface structure of the rotor where the helical grooves are provided.

FIG. 7 shows a section of a rotor side wall portion formed with the helical grooves 3, wherein the surface of the rotor side wall portion is applied with a surface treatment so as to provide it with an anti-wearing layer 5. By utilizing an anti-wearing layer, heavy wearing of the rotor side wall portion formed with the helical groove 3, which causes local wearing of the rotor even when said rotor side wall portion comes into direct contact with the inner surface of the side housing is avoided.

The invention being thus described, it will be obvious that the same may be varied in many ways. Such variations are not to be regarded as a departure from the spirit and scope of the invention, and all such modifications are intended to be included within the scope of the following claims.

I claim:

1. A structure for preventing oil leakage in a rotary engine which comprises a casing having at least two side housings and a center housing positioned therebetween, a rotor, rotatably disposed within said casing, said rotor being adapted to rotate eccentrically within said casing, an annular oil seal groove formed in the side wall of the rotor, an annular oil seal ring mounted in said annular oil seal groove for maintaining gas tightness and oil tightness between a side wall of the rotor and a side housing, and at least one oil groove formed in the side wall of the rotor and located radially inside of said annular oil seal groove, said oil groove having a gradually increasing cross-sectional area from its radial outer end toward its radial inner end, a closed radial outer end and an opened radial inner end, said oil groove extending helically around the center of the rotor.

2. The structure according to claim 1, wherein the rotor side wall portion where said oil grooves are formed is provided with an anti-wearing layer.

3. The structure according to claim 1, wherein a plurality of oil grooves are provided.

4. The structure according to claim 3, wherein said plurality of oil grooves are arranged to form multi-layered helical groove means.

5. The structure according to claim 3, wherein said plurality of oil grooves extend radially from the center of the rotor to the vicinity of the annular oil seal groove, each of said oil grooves overlapping a portion of the length of its adjacent oil groove as seen in the direction of rotation of the rotor.

6. The structure according to claim 1, wherein a single oil groove is formed in the side wall of the rotor, said oil groove extending helically from the center of the rotor to the annular oil seal groove thereby forming a plurality of overlapping oil grooves between the center of the rotor and the annular oil seal groove.

7. The structure according to claim 6, wherein the helical groove opens radially outwardly along the rotating direction of the rotor.

* * * * *

UNITED STATES PATENT OFFICE

CERTIFICATE OF CORRECTION

Patent No. 3,945,776 Dated March 23, 1976

Inventor(s) M. Morita

It is certified that error appears in the above-identified patent and that said Letters Patent are hereby corrected as shown below:

In the Heading of the Patent, that portion concerning "[30] Foreign Application Priority Data" should read as follows: -- [30] Foreign Application Priority Data
December 29, 1973 Japan . . . . 49-580 --

Signed and Sealed this

Seventh Day of September 1976

[SEAL]

*Attest:*

RUTH C. MASON
*Attesting Officer*

C. MARSHALL DANN
*Commissioner of Patents and Trademarks*